United States Patent [19]

Thebaud

[11] 4,322,109

[45] Mar. 30, 1982

[54] MODULAR CONTOURED FURNITURE

[76] Inventor: Sacha Thebaud, P.O. Box 446, Port-au-Prince, Haiti

[21] Appl. No.: 95,461

[22] Filed: Nov. 19, 1979

Related U.S. Application Data

[63] Continuation of Ser. No. 889,936, Mar. 27, 1978, abandoned.

[51] Int. Cl.[3] ..... A47C 4/00

[52] U.S. Cl. ..... 297/25; 297/56; 108/118; 248/164

[58] Field of Search ..... 297/18, 24, 25, 23, 297/31, 45, 42, 51-56, 440; 108/118; 248/164, 432; D6/76

[56] References Cited

U.S. PATENT DOCUMENTS

| | | | |
|---|---|---|---|
| 404,589 | 6/1889 | Batt | 297/31 |
| 614,997 | 11/1898 | Sairth | 297/284 |
| 947,090 | 1/1910 | Wolfe | 297/56 X |
| 1,493,663 | 5/1924 | Binder | 297/42 |
| 2,073,155 | 5/1937 | Ivey | 297/25 X |
| 3,131,970 | 5/1964 | McGregor | 297/440 |
| 3,156,502 | 11/1964 | Chisholm | 297/440 X |
| 3,907,359 | 9/1975 | Joiner | 297/56 |
| 4,239,280 | 12/1980 | Ackerman | 297/18 |

FOREIGN PATENT DOCUMENTS

| | | | |
|---|---|---|---|
| 144/31 | 1/1931 | Australia | 297/25 |
| 801976 | 5/1936 | France | D6/76 X |

*Primary Examiner*—Francis K. Zugel

*Attorney, Agent, or Firm*—Hauke and Patalidis

[57] ABSTRACT

Contoured furniture, such as chairs and tables, made of elongated profiled slats disposed substantially parallel to each other in at least two separate groups. The profiled and contoured slats in each group are attached together in spaced relationship at least at one of their ends, and the two groups of slats are interlaced along a crossing hinge area, such as to form an X-shaped piece of furniture when viewed from a side. Tension rod members are provided for rigidly holding the two groups of interlaced contoured slats relative to each other.

10 Claims, 24 Drawing Figures

FIG. 1
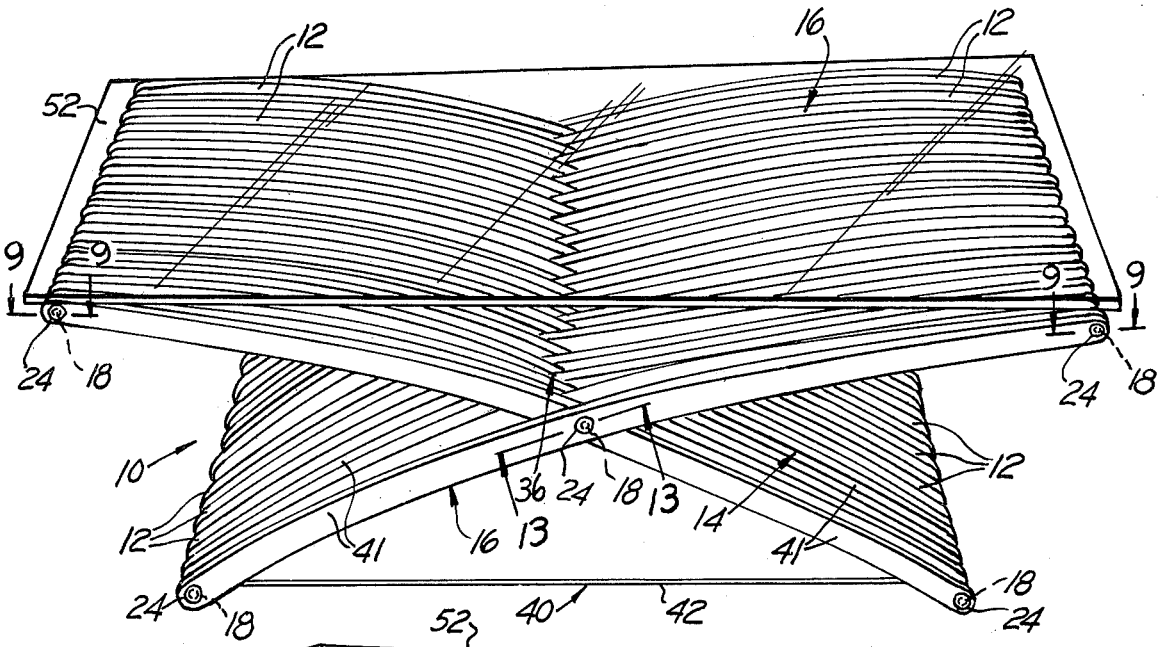
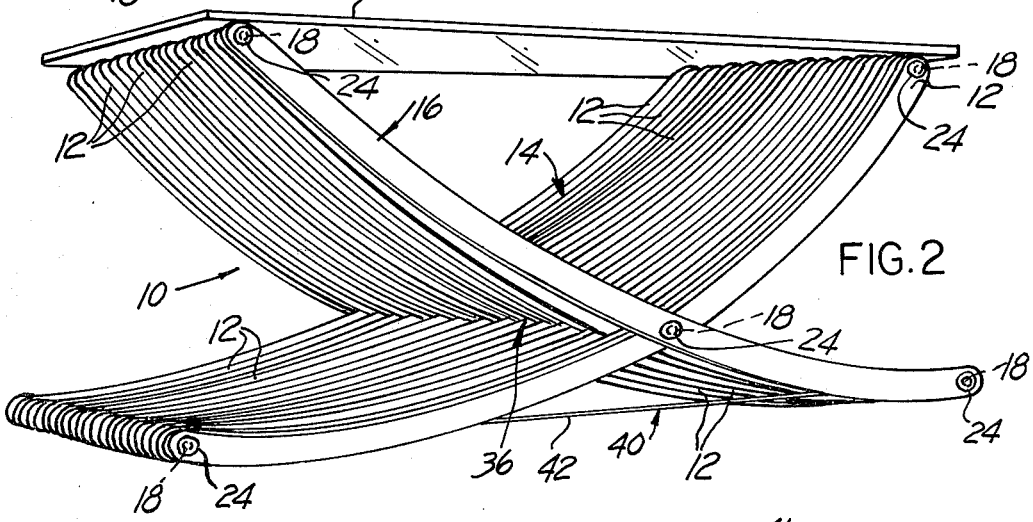
FIG. 2
FIG. 14
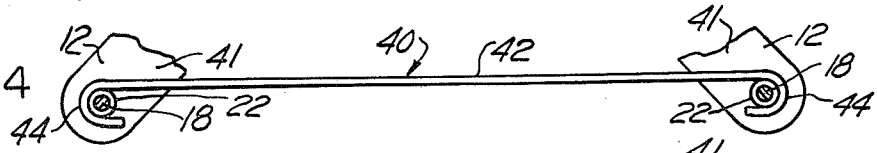
FIG. 15
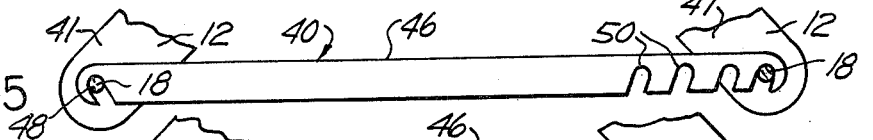
FIG. 16
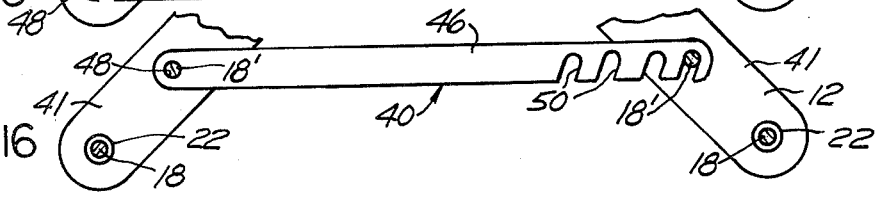

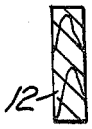
FIG.6
FIG.7
FIG.8
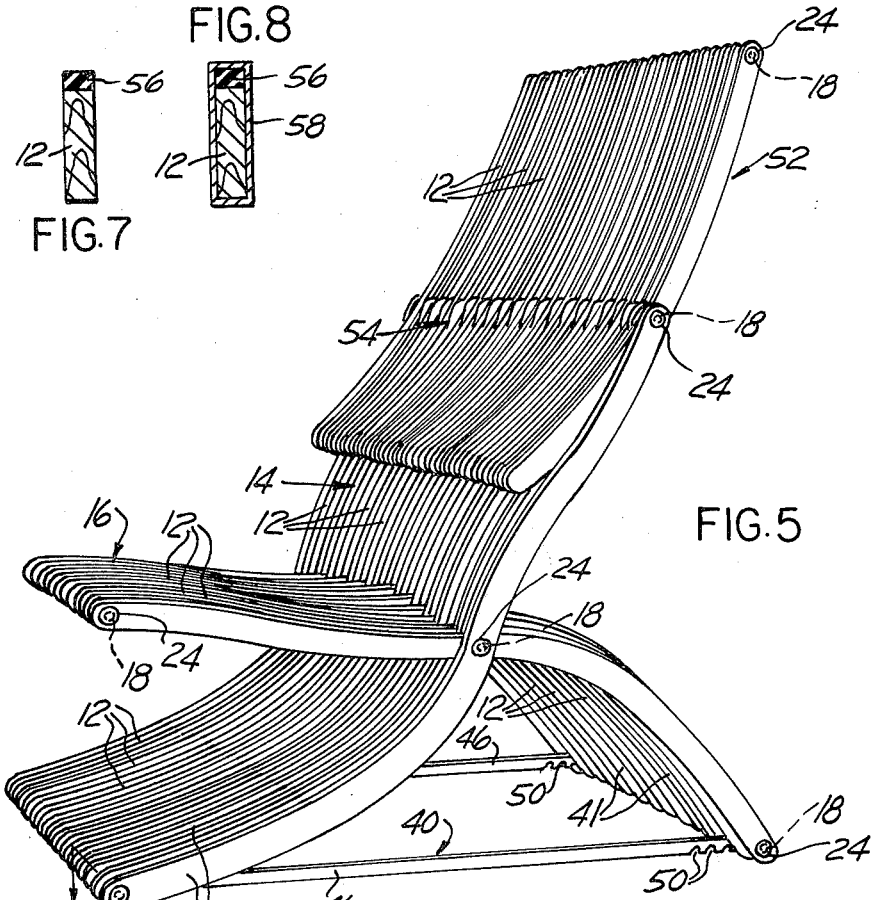
FIG.5
FIG.11
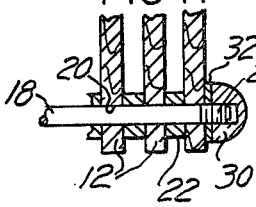
FIG.10
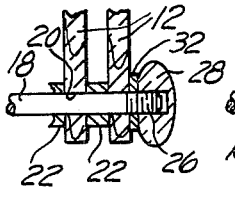
FIG.9
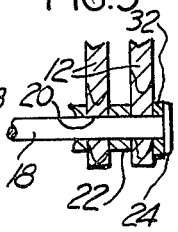
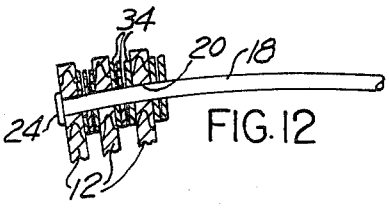
FIG.12
FIG.17
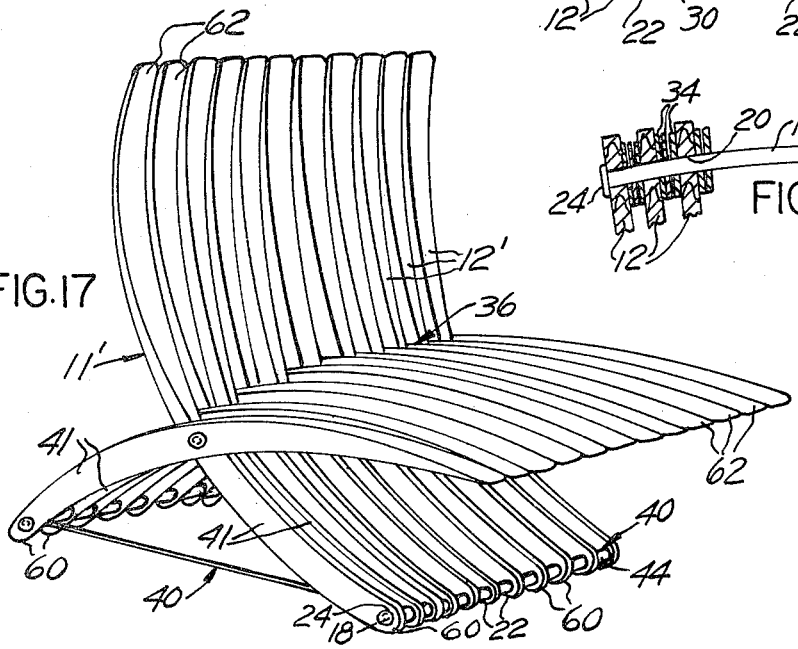
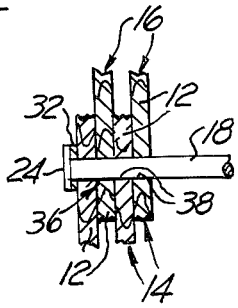
FIG.13

FIG. 18
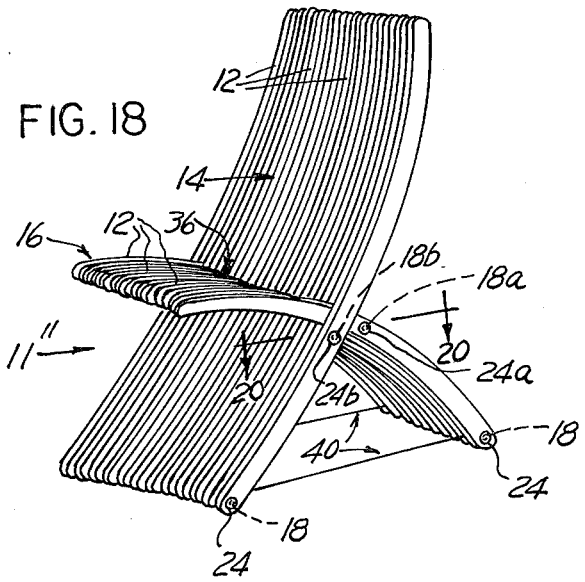
FIG. 19
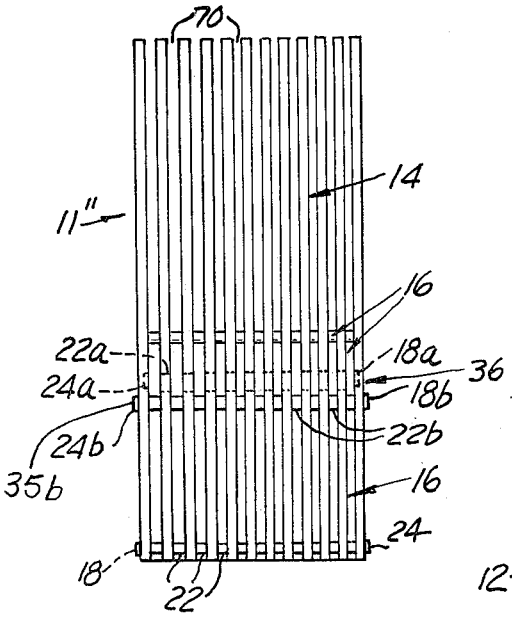
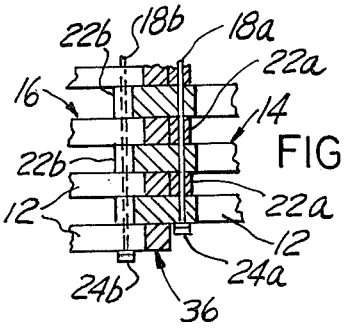
FIG. 20
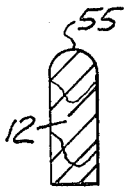
FIG. 21
FIG. 22
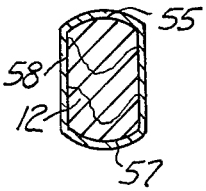
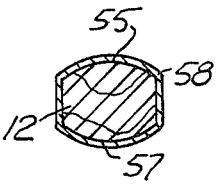
FIG. 23
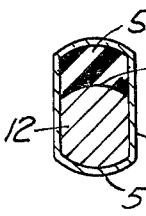
FIG. 24

MODULAR CONTOURED FURNITURE

This is a continuation of application Ser. No. 889,936, filed Mar. 27, 1978, abandoned.

BACKGROUND OF THE INVENTION

The present invention relates to a system of furniture, such as tables and chairs, formed of a plurality of profile contoured slats disposed in at least two separate groups criss-crossing or interlacing each other, and providing a modular simple construction with a minimum of different parts, while still presenting an aesthetic appearance.

It is known, for example as disclosed in U.S. Pat. Nos. 3,907,359 and Des. 240,873, to make foldable chairs of slats joined at one end and forming a seat portion and a back portion in which the lateral slots of the back and of the seat extend farther than the remaining of the slats in order to form legs for the chair. To hold the chair in position, intermediary tension members are mounted for interconnecting the slats forming the seat with those forming the back of the chair to provide stability when the chair is unfolded.

SUMMARY

The present invention provides a complete system of modular construction for tables and chairs, including back-reclining highchairs, made of profiled and contoured slats, substantially alike, disposed in two separate groups, the slats in one group being interlaced along a joining area with the slats of the other group, at least one end of each group of slats being interconnected with spacers disposed between adjoining slats. Such an arrangement permits the article of furniture, table or chair, to be foldable for transportation or storage, and to be capable of being erected for use in a fixed position or in an adjustable position according to whether a tension rod of fixed dimension or of adjustable length is used for holding the article of furniture in its erected position.

The contiguous individual slats may all have the same profile, or they may be made of progressively evolving profile to provide variety in design, and in a chair structure, to provide a contoured body support shape. Preferably, all the slats extend from one end to the other of each group of slats, such that the support legs for the article of furniture are very rigid, strong and stable, as consisting of the plurality of slats in each group.

The principal object of the present invention is therefore to provide a new system of modular furniture which may be mass-produced by relatively unskilled labor and which requires only a small variety of structural parts, all alike or similar, to supply a multitude of physical appearances in the finished articles.

The many objects and advantages of the present invention will be apparent to those skilled in the art when the following description of the best mode contemplated for practicing the invention is read in conjunction with the accompanying drawing wherein like reference numerals relate to like parts throughout the several views, and in which:

BRIEF DESCRIPTION OF THE DRAWINGS

FIG. 1 is a top perspective view of a table constructed according to the present invention;

FIG. 2 is a side perspective view of the table of FIG. 1 disposed in a reversed position on a floor;

FIG. 5 is a perspective view of the highchair of FIG. 4;

FIGS. 6–8 are cross-sectional views of examples of slats used for constructing an article of furniture according to the present invention;

FIG. 9 is a partial sectional view on line 9—9 of FIG. 5;

FIGS. 10–12 are modifications of the structure illustrated at FIG. 9;

FIG. 13 is a partial section on line 13—13 of FIGS. 1 and 5;

FIGS. 14–16 are examples of alternate arrangements for tension rods adapted to maintain an article of furniture according to the present invention in its erected state;

FIG. 17 is a perspective view of another example of chair according to the present invention;

FIG. 18 is a perspective view of a further example of chair according to the present invention;

FIG. 19 is a front elevation view thereof;

FIG. 20 is a partial section thereof substantially along line 20—20 of FIG. 18; and FIGS. 21–24 are cross-sectional views of further examples of slats used for constructing an article of furniture according to the present invention.

DETAILED DESCRIPTION OF THE PREFERRED EMBODIMENTS

Figure 3:
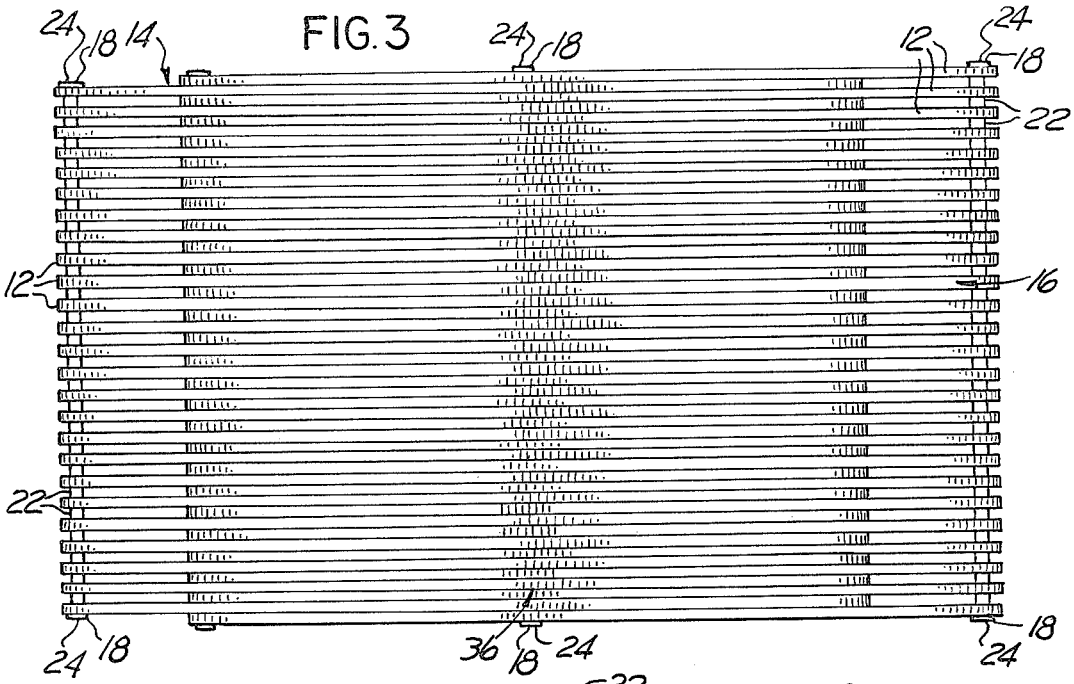
FIG. 3 is a top plan view of the table of FIG. 1.

Referring to the drawings, and more particularly to FIGS. 1–3, thereof, a table 10 according to the present invention comprises a plurality of slats 12 disposed in two separate groups 14 and 16. The slats 12 in each group are substantially rectangular in cross-section, FIG. 6, and are made of any convenient material such as hard wood, plywood, plastic or metal. The slats 12 of each group are joined at each end in spaced relationship, as best shown in FIG. 9, by means of a rod 18 passed through an aperture 20 in each slat 12, proximate the end of the slat. A spacer 22, in the form of a thick washer having a thickness substantially equal to the width of each slat 12, is disposed between consecutive adjacent slats surrounding the rod 18. The end of the rod 18 is enlarged by peening or hammering, as shown at 24, in a rivet-like manner, to hold together, in laterally spaced relationship, each end of a group of slats 12. As an alternate connecting means, the rods 18 may be threaded on their ends, as shown at FIGS. 10 and 11 at 26, and a decorative bolt, for example in the elliptical shape 28 of FIG. 10 or in the hemispherical shape 30 of FIG. 11, is used for anchoring the rod 18 at the end of the spaced assembled slats 12, a washer 32 being disposed, if so desired, below the nut 28 or 30. In structures where it is desired to use a connecting rod 18 which is curvilinear rather than straight, as shown at FIG. 12, the solid thick washer spacers 22 are replaced by a plurality of thin washers 34 disposed between adjacent consecutive slats 12, for the purpose of facilitating the assembly without interfering with the curvature of the rod 18.

Referring back to FIGS. 1–3, the table 10 is formed of the two groups 14 and 16 of slats 12 criss-crossing and interlacing each other as shown at 36. A rod 18, passed through aligned apertures 38, FIG. 13, through each slat 12 of both groups 14 and 16 of slats, at the interlacing junction 36 of the slats, forms a common pivot point for the groups 14 and 16 of the spaced slats 12. The ends of the junction rod 18 securing the slats at their interlacing hinging junction 36 may be secured by flattening the end as shown at 24 at FIG. 13, or by any other means such as the threaded nuts 28 or 30 illustrated at FIG. 10 or 11.

For the purpose of holding the table 10 in an erected position, one tension bar 40 or, preferably, a pair of tensions bars 40 disposed one on each side, interconnect the lower ends of one of the slats 12 of the group 14 of slats to one of the slats 12 of the group 16 of slats. The portion of each group of slats below the interlacing legs 41 of junction 36 forms the support of the table 10. Each tension bar 40 consists of a rod 42, as best shown at FIG. 14, made of steel or like material and provided on each end with a partial loop 44 engageable over the washer spacer 22 between consecutive adjoining slats 12. It is readily apparent that one of the loops 44 may be completely closed such as to be permanently attached over a washer or spacer 22, or it may be directly fastened over the rod 18, the washer spacer 22 being omitted.

Alternatively, as shown on FIG. 15, the tension bar 40 may be in the form of a rectangular, in cross-section, bar 46, having a transverse aperture, or preferably an inclined slot or notch 48 for pivotal and removable attachment directly to the rod 18, and one inclined notch, or preferably a plurality of notches, 50, for hooking over the rod 18 interconnecting the slats 12 forming the other leg 41. Such an arrangement, as illustrated at FIG. 15, provides an adjustment of the distance of spread of the legs 41 of the table 10 of FIGS. 1–3, by providing a choice of which one of the notches 50 is hooked over the holding rod 18.

It will be appreciated that the tension bar 40 may be mounted at any other appropriate location along the length of the legs 41 or, if so desired, even above the hinging interlaced joint 36. FIG. 16 illustrates an example of a tension bar 40 in the form of a rectangular bar 46 mounted at some intermediate distance from the bottom of legs 41 by means of an intermediary rod 18', interconnecting the slats 12 forming a first leg 41, the rod 18' being passed through the notch 48 at one end of the bar 46, the other end of the bar 46 being provided with a plurality of notches 50, adjustably capable of being hooked over an auxiliary rod 18', interconnecting in spaced relationship the slats 12 of the other leg 41.

Referring once again to FIGS. 1–3, the table 10 may be placed on the ground in the position indicated at FIG. 1 or in the position reversed relative to the position of FIG. 1, as shown at FIG. 2. The table 10 may be used as such, for example as a magazine rack or the like, or a marble slab or a glass top, as illustrated at 52, may be placed on the top to provide a flat surface. Without a top 52, the table may be converted to a seat or hassock, for example, by placing a cushion on the top surface of the slats 12.

Figure 4:
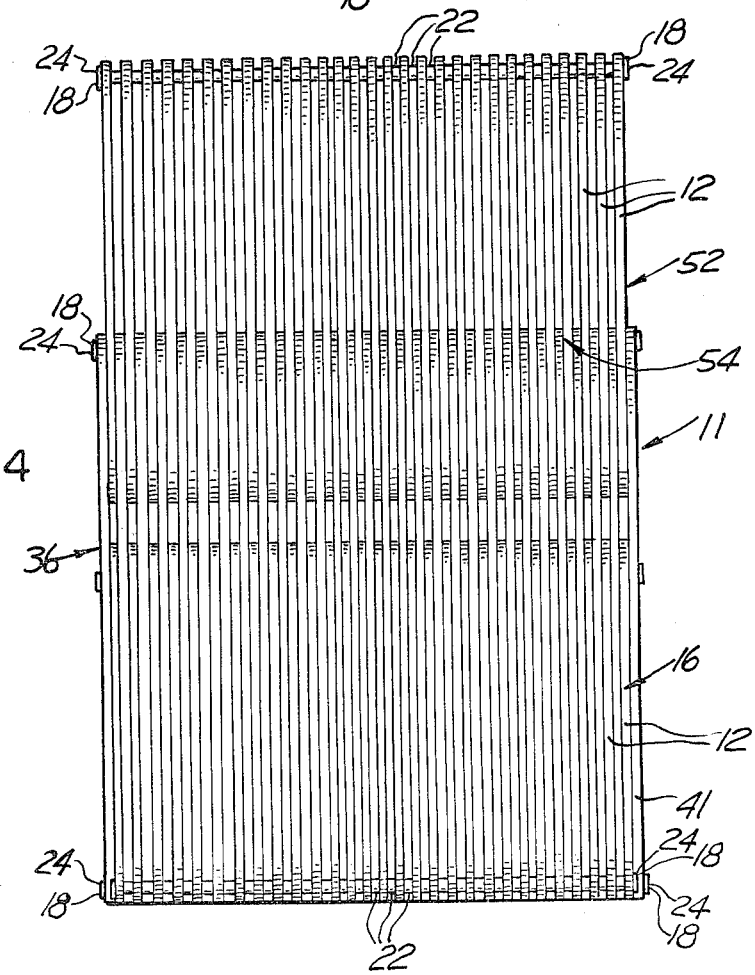
FIG. 4 is a rear elevation view of a highchair made according to the modular construction of the present invention.

It is also readily apparent that by a slight modification of the shape of one group of slats 12, for example by making the group 14 of slats 12 of the structure of FIG. 2, projecting above the interlaced hinging junction 36 longer than the corresponding group 16 of slats 12 projecting above the hinging junction, a low chair will be formed, the group 16 of slats 12 defining the seat of the chair and the group 14 defining the back of the chair. A substantially similar arrangement is shown at FIGS. 4–5 illustrating a chair 11 provided, however, with a reclining back portion 52. Otherwise, the chair 11 of FIGS. 4–5 is constructed according to the same principle as previously described, and is made of a plurality of contoured slats 12 disposed in two separate groups 14 and 16 cross-crossing each other and interlaced at a hinged junction 36 at approximately equal distance between the ends of the slats 12 disposed in each group 14 or 16. The chair 11 is held in its erected position by means of adjustable traction bars 40, and the reclining back portion 52 is formed of a plurality of laterally disposed spaced apart slats 12 having an end interconnected by means of washer spacers 22 and a rod 18. The top end of the group 14 of slats 12 pivotally supports, as shown at 54, the assembly of slats forming the rectangular back 52 at substantially mid-distance between the ends of the slats of the reclining back 52. The lower end of the slats 12 of the reclining back 52 are spaced apart and devoid of any interconnecting means such as to be capable of pivotally retracting in unison flush with the slats 12 of the group 14 of slats forming the back of the chair 11, or to be extended therefrom in any position corresponding to the inclination of the reclining tack 52, pivoting about the axis of the hinging support 54 formed by a rod 18 passed through aligned apertures in the ends of the slats 12 forming the back of the chair and in the ends of the slats 12 forming the reclining back portion 52.

As previously mentioned, the slats 12 are substantially rectangular in cross-section, as shown at FIG. 6, and they may be made of any appropriate material, such as hard wood, plywood, plastic or metal. If it is desired to provide the slats 12 with a soft, resilient surface, the slats are covered on one of their edges with a strip 56 of elastomeric material, FIG. 7, cemented or otherwise bonded on the edge surface. Also, if so desired, the slats 12 may be covered with a sheath of pliable upholstery or other material, for decorative purposes. FIG. 8 illustrates such a structure wherein a slat 12 is provided on one edge with a strip 56 of elastomeric material bonded thereon, and entirely covered by a sleeve 58 of upholstery, canvas, or other material. Straw, ropes, strings, or like materials, can also be coiled around the slats.

The slats 12 may also be provided with a rounded top, as shown at 55 at FIGS. 21–24, or with a rounded top 55 and a rounded bottom 57, as shown at FIGS. 22–24. In addition, it is readily apparent that the slats 12 may be made of any appropriate convenient width, as shown at FIGS. 22 and 24, or may be relatively thin with substantial width as shown at FIG. 23. FIGS. 22 and 23 show a slat 12 covered with a sleeve 58 of upholstery, canvas or elastomeric material, while FIG. 24 further shows a slat 12 provided on the top with a cushion 56 of elastomeric material and a sleeve 58.

FIG. 17 illustrates a modified chair 11', according to the principle of the present invention as will be immediately apparent, but wherein the slats 12', instead of being of constant thickness and width, gradually and progressively increase in width from a narrow thick end 60 to a wide gradually thin end 62. The slate 12' are of substantially equal width where they hingedly interlace with each other at 36, at substantially middistance from the ends 60 and 62. Preferably, the slats 12' at their widest end 62 are separated by a space substantially equal to the width of the slats at their narrowest end 60, to avoid pinching of the skin of a person sitting on the chair 11' and to permit nesting of the narrow end 60 of the slats of the forward leg 41, when the chair is collapsed, within the narrow space between adjacent large ends 62 of the slats of the seat portion of the chair. The narrow ends 60 of the slats 12' are held together, as previously explained in detail hereinbefore, by means of a connecting rod 18, with spacers 22 interposed between adjacent slats, and preferably the narrow ends 60 of the slats are disposed such as to form the legs 41 of the chair 11'.

Referring now to FIGS. 18–20 there is shown a chair 11' formed of a plurality of slats 12 also disposed in two separate groups 14 and 16. The slats 12 in the group 14 are interconnected at one of their ends in spaced relationship by means of a rod 18 and spacers 22, as previously described, and the group 16 of slats are similarly interconnected at one end in spaced relationship. The slats 12 in each group 14 and 16 are not interconnected at their other end, as best shown at 70 at FIG. 19. At some point intermediate the ends of the slats 12 in the group 14, the slats are interconnected in spaced relationship by means of a rod 18*a*, having flattened retaining ends 24*a*, appropriate spacers 22*a*, through which is passed the rod 18*a*, being disposed between consecutive slats 12. Similarly, the slats 12 of the group 16 of slats are interconnected at some intermediate point between their ends by means of a rod 18*b*, having flattened ends 35*b* passing through spacers 22*b*. The two groups of slats 14 and 16 are interlaced, and the bottom surface of the slats 12 in the group 16 engage a portion of the peripheral surface of the spacers 22*a*, while the bottom surface of the slats 12 of the group 14 engages a portion of the peripheral surface of the spacers 22*b*, thus forming a hinging joint 36 substantially where the slats 12 interlace. The weight of the body of a person sitting on the seat formed by the free end of the slats 12 in the group 16, together with the pressure applied by the back of a person on the group 14 of slats 12 defining the back of the chair 11', hold the chair 11' in a sturdy erected position, tension rods 40 being disposed so as to prevent the interconnected slats 12 in each group, forming the legs of the chair, from spreading apart.

It will be readily apparent that the chair 11' of FIGS. 18–20 can be easily dismantled for transportation and storage into the two separate groups 14 and 16 of slats and the separate tension rods 40.

Having thus described the present invention by way of examples of structural embodiments thereof, modification whereof will be apparent to those skilled in the art, what is claimed as new is as follows:

I claim:

1. A modular furniture construction comprising a first group of similar spaced apart parallel slat members of substantially equal length and of a first predetermined curved side profile, a second group of similar spaced apart parallel slat members of substantially equal length and of a second predetermined curved side profile, said second group of slat members being interlaced with said first group of slat members and being hingedly interconnected therewith where they interlace, means rigidly interconnecting said slat members in spaced relationship at each end thereof, and at least one tension bar member rigidly holding said first group and said second group of slat members in a predetermined relative angular disposition relative to the area of interlacing, said tension bar member being attached at each end to said means interconnecting said slat members in spaced relationship, wherein said first and second groups of slat members are interlaced intermediate the ends of each group, said means interconnecting said slat members at each end thereof comprises a rod passing through aligned apertures disposed proximate the end of said slat members, annular spacers disposed between consecutive adjacent slat members in each group for maintaining said consecutive adjacent slat members spaced apart at a substantially constant distance from each other which is at least equal to the width of said slat members, said rod passing through said annular spacers, and means at the end of said rod for anchoring together said rod, said annular spacers and said slat members, and wherein the opposite ends of the slat members of each of said groups define multiple legs for directly supporting said modular furniture structure.

2. The modular furniture construction of claim 1 wherein said slat members are of substantially constant thickness from one end to the other.

3. The modular furniture construction of claim 1 wherein said slat members gradually taper in thickness from one end to the other.

4. The modular furniture construction of claim 3 wherein said slat members progressively increase in width from said one end to the other, and wherein said narrow ends of said slat members are interconnected in spaced relationship and define legs for said furniture.

5. The modular furniture construction of claim 1 wherein said tension bar member is adjustable in length.

6. The modular furniture construction of claim 1 further comprising at least a third group of slat members hingedly interlaced with at least one of said two groups of slat members at a location other than said first hinging location.

7. The modular furniture construction of claim 1 further comprising a strip of elastomeric material attached at least to an edge of each of said slat members.

8. The modular furniture construction of claim 1 further comprising a sheath of pliable material covering each of said slat members.

9. The modular furniture construction of claim 1 wherein said first and second group of slat members are hingedly interconnected by means of a rod passed laterally through each of said slat members where they interlace.

10. The modular furniture construction of claim 1 wherein said first and said second group of slat members are hingingly interconnected by means of separate rods transversely passing one through said first group and the other through said second group, the slat members above each group being held in spaced relationship by means of spacer members.

* * * * *

UNITED STATES PATENT AND TRADEMARK OFFICE

CERTIFICATE OF CORRECTION

PATENT NO. : 4,322,109

DATED : March 30, 1982

INVENTOR(S) : Sacha Thebaud

It is certified that error appears in the above-identified patent and that said Letters Patent are hereby corrected as shown below:

Col. 5, line 6, change "11'" to --11"--, line 33, change "11'" to --11"-- (both occurrences), line 37, change "11'" to --11"--.

Signed and Sealed this

*Twenty-ninth* Day of *June 1982*

[SEAL]

*Attest:*

GERALD J. MOSSINGHOFF

*Attesting Officer*

*Commissioner of Patents and Trademarks*